United States Patent [19]

Dobashi et al.

[11] Patent Number: 4,562,379

[45] Date of Patent: Dec. 31, 1985

[54] GLOW SWITCH STARTER HAVING METAL OXIDE DEPOSIT

[75] Inventors: Yoshitomi Dobashi, Fujisawa; Masahiko Asakura, Yokosuka; Kohtaro Kohmoto, Yokohama, all of Japan

[73] Assignee: Tokyo Shibaura Denki Kabushiki Kaisha, Kawasaki, Japan

[21] Appl. No.: 501,093

[22] Filed: Jun. 6, 1983

[30] Foreign Application Priority Data

Jun. 10, 1982 [JP] Japan ..... 57-98552

[51] Int. Cl.[4] ..... H01J 17/16; H01J 17/24

[52] U.S. Cl. ..... 313/619; 313/553; 313/562; 337/27

[58] Field of Search ..... 313/619, 553, 558, 562; 337/27; 427/77, 106

[56] References Cited

U.S. PATENT DOCUMENTS

| | | | |
|---|---|---|---|
| 2,372,295 | 3/1945 | Rubenstein et al. | 200/113.5 |
| 2,457,487 | 12/1948 | Peacock et al. . | |
| 2,650,278 | 8/1953 | Foulke | 200/113.5 |
| 3,681,639 | 8/1972 | Kamei et al. | 313/619 X |

FOREIGN PATENT DOCUMENTS

| | | | |
|---|---|---|---|
| 997961 | 7/1965 | United Kingdom | 313/619 |

OTHER PUBLICATIONS

Ahearn et al., IBM Technical Disclosure Bulletin, "Eliminating Gas Impurities in a Gas Display Panel", vol. 15, No. 8, Jan. 1973, p. 2516.

*Primary Examiner*—Leo H. Boudreau
*Assistant Examiner*—K. Wieder
*Attorney, Agent, or Firm*—Cushman, Darby and Cushman

[57] ABSTRACT

In a glow switch starter comprising an airtight envelope in which a dischargeable gas is contained, and an electrode assembly hermetically sealed in one end of the envelope and having a stem in which a pair of electrodes are set, one or both of which are movable electrodes, a film formed of a mixture of 40% to 90% (by weight) metal barium and 60% to 10% (by weight) metal oxide is deposited on that region of the inner surface of the envelope, which is spaced apart from the stem, at a rate of 0.4 mg to 12.5 mg per cubic centimeter of the envelope capacity.

6 Claims, 5 Drawing Figures

GLOW SWITCH STARTER HAVING METAL OXIDE DEPOSIT

BACKGROUND OF THE INVENTION

This invention relates to a glow switch starter, and more specifically to an improved glow switch starter with less deviation in starting characteristics, such as starting voltage, initial glow discharge period, etc.

In some glow switch starters used for starting discharge lamps such as preheat-start type fluorescent lamps, metal barium is deposited on the inner wall of a glass bulb as an airtight envelope and on a discharge electrode. The metal barium serves to keep the starting voltage of the glow switch starter at a predetermined value and to reduce the deviation of the value. In a conventional method of depositing metal barium on the glass bulb and electrode, barium azide $Ba(N_3)_2$ is deposited on the inner surface of the glass bulb and the electrode, a stem in which the electrode is set is hermetically sealed in the glass bulb, the glass bulb is evacuated to form a vacuum and is then heated to thermally decompose the barium azide. According to this method, however, the thermal decomposition of the barium azide in the vacuum is performed explosively, so that metal barium from the barium azide deposited on the inner surface of the glass bulb scatters and sticks to the electrode during the thermal decomposition. Consequently, an excessive amount of metal barium is attached to the electrode to lower the starting voltage of the glow switch starter below the desired value. If the amount of barium azide deposited on the inner surface of the glass bulb is reduced to prevent so much metal barium from sticking to the electrode, the desired amount of metal barium may not be able to be deposited on the inner surface of the bulb. As a result, the gettering effect of the metal barium cannot be fully exhibited, so that tht initial glow discharge period of the glow switch starter and hence the ignition time of the lamp will be extended.

SUMMARY OF THE INVENTION

The object of this invention is to provide an improved glow switch starter which has fewer deviations in starting characteristics, such as starting voltage, initial glow period, etc.

According to this invention, there is provided a glow switch starter which comprises an airtight envelope in which a dischargeable gas is contained, and an electrode assembly hermetically sealed in one end of the envelope and having a stem in which a pair of electrodes are set, one or both of which are movable electrodes, wherein a film formed of a mixture of 40% to 90% (by weight) metal barium and 60% to 10% (by weight) metal oxide is deposited on that region of the inner surface of the envelope which is spaced apart from the stem, at a rate of 0.4 mg to 12.5 mg per cubic centimeter of the envelope capacity.

DETAILED DESCRIPTION OF THE PREFERRED EMBODIMENTS

Figure 1:
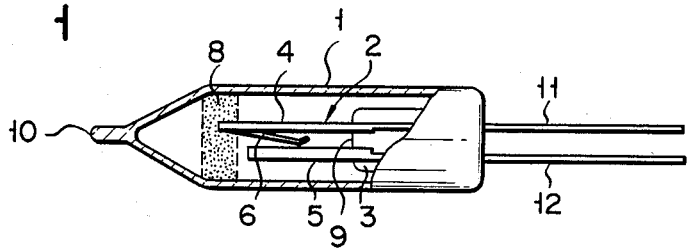
FIG. 1 is a partial sectional view of a glow switch starter according to one embodiment of this invention.

FIG. 1 is a partial sectional view of a glow switch starter according to one embodiment of this invention. In FIG. 1, an electrode assembly 2 is housed in a glass bulb 1 with an inside diameter of 6 mm. The electrode assembly 2 is composed of a stem 3 and a pair of inner leads 4 and 5 pinched in the stem 3. A movable electrode 6 formed of a bent bimetal is welded to the extreme end portion of the one inner lead 4, while the other inner lead 5 constitutes a fixed electrode. Argon or a gas mixture of argon and neon (e.g., 1% Ar and 99% Ne) as a dischargeable gas is contained in the glass bulb 1.

A film 8, which will be described in detail later, is deposited on that region of the inner surface of the glass bulb 1 which is spaced from the top 9 of the stem 3. The region covered with the film 8 is a belt-shaped region of the inner surface of the bulb 1, having a width of approximately 3 to 4 mm. The forward edge of the covered region is at a distance of approximately 8 to 10 mm from the top 9 of the stem 3. An exhaust tube is connected to the apex of the glass bulb 1 before the gas mixture is introduced into the bulb 1. The gas mixture is introduced into the glass bulb 1 after the bulb 1 is exhausted by means of the exhaust tube. In FIG. 1, reference numeral 10 designates a tipped-off seal end formed after the gas mixture is introduced into the glass bulb 1.

The inner leads 4 and 5 set in the stem 3 are led out of the glow bulb 1 to serve as outer leads 11 and 12, respectively.

The film 8 deposited on the inner wall of the glass bulb 1 is formed of a mixture of 40% to 90%, e.g., 50%, by weight of metal barium and 60% to 10%, e.g., 50%, by weight of a binder such as aluminum oxide. The film is deposited at a rate of 0.4 mg to 12.5 mg, e.g., 1.4 mg, per cubic centimeter of the glass bulb capacity. The film-deposited region is located in a position spaced apart from the stem 3 because the starting voltage cannot be stabilized if the film 8 is deposited on the region near the stem 3 which is not a discharge region. The film 8 is formed by thermally decomposing a mixture of barium azide and aluminum oxide in a vacuum after depositing it on the predetermined region.

According to the glow switch starter of this invention, as described above, the existance of the binder prevents the metal barium from scattering and sticking to the electrode during the thermal decomposition of barium azide. Accordingly, the starting voltage is prevented from dropping excessively, and a fixed amount of metal barium is deposited on the inner wall of the bulb 1. Thus, the starting characteristics are improved, a satisfactory gettering effect is obtained, and the initial glow discharge period can be limited within a fixed time.

Examples of this invention will now be described to clarify the reason why the composition of the film and the amount of the film deposited are limited in the glow switch starter of the present invention.

EXAMPLE 1

Glow switch starters of the structure shown in FIG. 1 were made. Argon was contained in a glass bulb 1. They had films 8 of different Ba-$Al_2O_3$ mixtures and deposited in different amounts on the limited portions of inner surfaces of bulbs 1. Each limited inner surface portion was at a distance of about 8 to 10 mm from the top of a stem 3 and shaped like an annular band about 3 to 4 mm wide as measured in the direction toward the top of the bulb 1. Each of the starters was incorporated in a 120 V, 40 W fluorescent lamp. The lamp was operated, and the starting voltages and the initial glow discharge periods of the starters were measured.

The starting voltage of a glow switch starter in a 120 V, 40 W fluorescent lamp should be preferably 108 V or less to start discharge and should better be 80 V or more to prevent the starter from operating again. The initial glow discharge period of the starter of the lamp should better be 3.5 seconds or less. In view of this and from the data obtained by the experiment described above, it was found that the film 8 should be formed of a mixture consisting of 40 to 90% by weight of Ba and 10 to 60% by weight of $Al_2O_3$ and that the film 8 should be used in an amount of 0.4 to 12.5 mg per cubic centimeter of the bulb 1.

Figure 2:
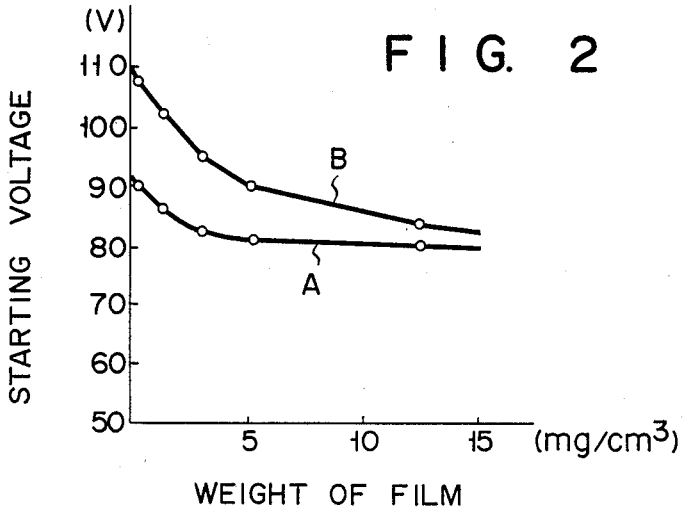
FIG. 2 is a graph showing the relationship between a starting voltage and a weight of a film in a glow switch starter incorporated in a 120 V, 40 W fluorescent lamp.
Figure 3:
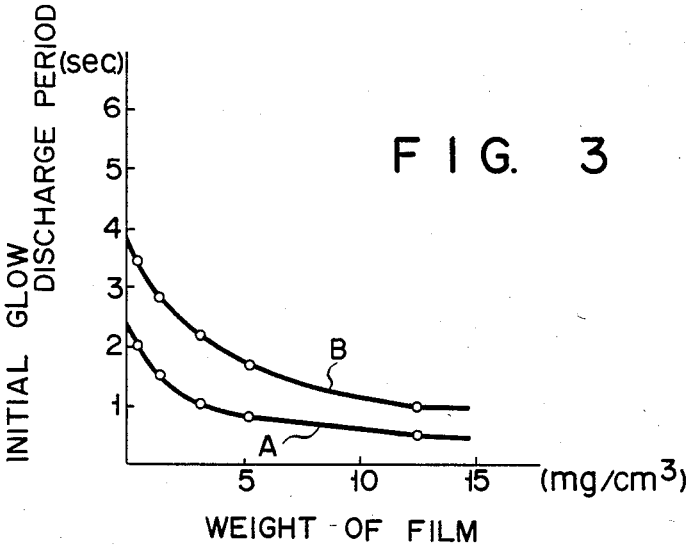
FIG. 3 is a graph showing the relationship between an initial glow discharge period and a weight of a film in a glow switch starter incorporated in a 120 V, 40 W fluorescent lamp.

FIG. 2 is a graph illustrating the relationship between the starting voltage and the amount of Ba-$Al_2O_3$ mixture (mg/$cm^3$). FIG. 3 is a graph showing the initial glow discharge period and the amount of Ba-$Al_2O_3$ mixture (mg/$cm^3$). In these figures, curve A indicates said relationships concerning the starters with films 8 made of a mixture consisting of 90% by weight of Ba and 10% by weight of $Al_2O_3$ and curve B represents said relationships concerning the starters with films 8 made of a mixture consisting of 40% by weight of Ba and 60% by weight of $Al_2O_3$. As evident from FIGS. 2 and 3, the starting voltage fell within the above-mentioned range, i.e., from 80 V to 108 V, and the initial glow discharge period was 3.5 seconds or less when the film 8 made of a mixture consisting of 40 to 90% by weight of Ba and 10 to 60% by weight of $Al_2O_3$ was used in an amount of 0.4 to 12.5 mg per cubic centimeter of the bulb 1.

EXAMPLE 2

Each of glow switch starters of the same structures as those used in Example 1 except containing a gas mixture of 1% Ar and 99% Ne was incorporated in 220 V, 70 W high pressure sodium lamp. The lamp were operated, and the starting voltages and the initial glow discharge periods of the starters were measured.

Figure 4:
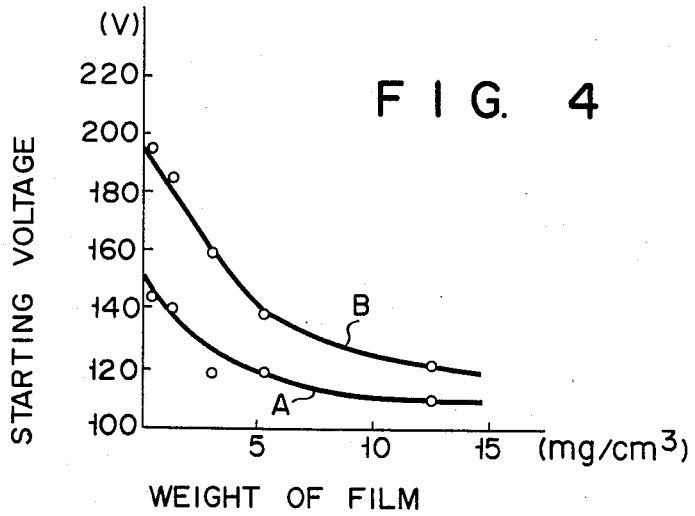
FIG. 4 is a graph showing the relationship between a starting voltage and a weight of a film in a glow switch starter incorporated in a 220 V, 70 W high pressure sodium lamp.
Figure 5:
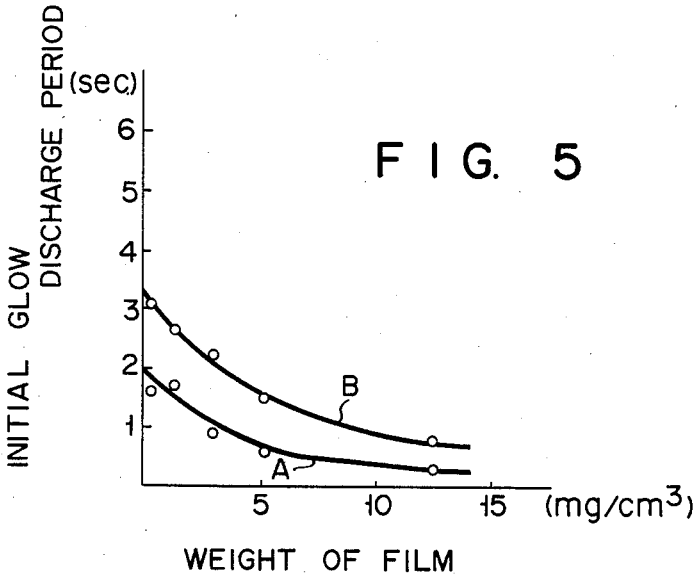
FIG. 5 is a graph showing the relationship between an initial glow discharge period and a weight of a film in a glow switch starter incorporated in a 220 V, 70 W high pressure sodium lamp.

The starting voltage of a glow switch starter in a 220 V, 70 W high pressure sodium lamp should be preferably 198 V or less to start discharge and be preferably 110 V or more to prevent the starter from operating again. In view of this and from the data obtained by the experiment described above, it was found that, exactly as in Example 1, the film 8 should be formed of a mixture consisting of 40 to 60% by weight of Ba and 10 to 60% by weight of $Al_2O_3$ and that the film 8 should be used in an amount of 0.4 to 12.5 mg per cubic centimeter of the bulb 1. FIGS. 4 and 5 illustrate these findings. In these figures, curve A indicates the aforementioned relationships concerning the starters with films 8 made of a mixture consisting of 90% by weight of Ba and 10% by weight of $Al_2O_3$ and curve B represents the aforementioned relationships concerning the starters with films 8 made of a mixture consisting of 40% by weight of Ba and 60% by weight of $Al_2O_3$.

In examples 1 and 2, the films 8 were formed by coating a $Ba(N_3)_2$-$Al_2O_3$ mixture on the inner surface of the bulbs 1 and then by evacuating and heating the bulbs, thereby causing the thermal decomposition of $Ba(N_3)_2$.

Although aluminum oxide was used for the binder in the Examples described above, this invention is not limited to these Examples. The same effect may be obtained with the use of titanium dioxide, silicon dioxide or another metal oxide for that purpose. In the Examples, moreover, the glow switch starter used a fluorescent lamp rated at 120 V, 40 W and a high-pressure sodium lamp rated at 220 V, 70 W. However, the same effects may be obtained with the use of other discharge lamps. While the Examples used a combination of a fixed electrode and a movable electrode, a couple of movable electrodes may alternatively be used for the same purpose. Even though the movable electrode is covered with the film formed of a fixed amount of metal barium or a mixture of metal barium and a binder, it is protected against deposition of excessive metal barium or the electrode, since the barium never scatters from the inner wall of the bulb 1. Thus, the desired starting characteristics may be obtained. The position of film deposition is not limited to the position stated in the Examples. For example, the film may extend to that portion of the inner wall of the glass bulb 1 which corresponds to the bent portion of the bimetal constituting the movable electrode.

What we claim is:

1. A glow switch starter comprising:

an airtight envelope, a dischargeable gas contained within said envelope, an electrode assembly hermetically sealed in one end of the envelope, said electrode assembly having a stem in which a pair of electrodes, one or both of which are movable electrodes, are set, a film formed of a mixture of 40% to 90% (by weight) metal barium and 60% to 10% (by weight) metal oxide being deposited only on a region of the inner surface of the envelope, which is spaced apart from the stem, deposition having been accomplished at a rate of 0.4 mg to 12.5 mg per cubic centimeter of the envelope capacity, said metal oxide limiting the amount of barium deposited on said electrodes thus preventing a starting voltage of said glow switch starter from dropping excessively.

2. The glow switch starter according to claim 1, wherein said metal oxide is at least one selected among a group including aluminum oxide, titanium dioxide, and silicon dioxide.

3. The glow switch starter according to claim 1, wherein said dischargeable gas is argon.

4. The glow switch starter according to claim 1, wherein said dischargeable gas is a gas mixture of argon and neon.

5. The glow switch starter according to claim 1, wherein said region of the inner surface of the envelope spaced from the stem extends from the position corresponding to a bimetal constituting the movable electrode to the apex of the envelope.

6. The glow switch starter according to claim 5, wherein said region of the inner surface of the envelope spaced apart from the stem is at a distance of 8 mm or more from the apex of the stem.

* * * * *